US009581356B2

(12) United States Patent
Papasideris

(10) Patent No.: US 9,581,356 B2
(45) Date of Patent: Feb. 28, 2017

(54) SUBSEA ROV-MOUNTED HOT WATER INJECTION SKID

(71) Applicant: Oceaneering International, Inc., Houston, TX (US)

(72) Inventor: Kosta Papasideris, Houston, TX (US)

(73) Assignee: Oceaneering International, Inc., Houston, TX (US)

( * ) Notice: Subject to any disclaimer, the term of this patent is extended or adjusted under 35 U.S.C. 154(b) by 0 days.

(21) Appl. No.: 15/061,698

(22) Filed: Mar. 4, 2016

(65) Prior Publication Data

US 2016/0258653 A1 Sep. 8, 2016

Related U.S. Application Data

(63) Continuation of application No. 62/129,728, filed on Mar. 6, 2015.

(51) Int. Cl.

| | |
|---|---|
| ***F24H 1/20*** | (2006.01) |
| ***B63B 59/08*** | (2006.01) |
| ***F24H 9/20*** | (2006.01) |
| ***F24H 1/00*** | (2006.01) |
| ***B63J 2/12*** | (2006.01) |
| ***B63G 8/00*** | (2006.01) |

(52) U.S. Cl.
CPC ..... *F24H 9/2014* (2013.01); *B63G 8/001* (2013.01); *B63J 2/12* (2013.01); *F24H 1/0018* (2013.01); *B63G 2008/002* (2013.01)

(58) Field of Classification Search
None
See application file for complete search history.

(56) References Cited

U.S. PATENT DOCUMENTS

| | | | | |
|---|---|---|---|---|
| 2,049,153 | A * | 7/1936 | Bronson | F24H 1/52 122/32 |
| 3,439,372 | A * | 4/1969 | Collier | B66F 11/046 15/50.1 |
| 3,521,704 | A * | 7/1970 | Bridegum | B60P 3/36 122/15.1 |
| 3,773,059 | A * | 11/1973 | Arneson | B63B 59/08 114/222 |
| 3,803,658 | A * | 4/1974 | Raubenheimer | E04H 4/1663 15/1.7 |
| 5,282,290 | A * | 2/1994 | VanFossen | E01H 1/005 15/180 |
| 5,385,106 | A * | 1/1995 | Langshaw | A01G 11/00 111/118 |
| 5,389,266 | A * | 2/1995 | Clum | C02F 1/02 134/19 |

(Continued)

*Primary Examiner* — Thor Campbell
(74) *Attorney, Agent, or Firm* — Maze IP Law, PC

(57) ABSTRACT

A remotely operated vehicle mountable hot water injection skid comprises skid frame, one or more floats, a power interface, one or more subsea power transformers, one or more electrical power interfaces, one or more data communication interfaces, one or more heater skid telemetry systems, a predetermined set of integration equipment, a water collection and heating container, a pumping and circulation system, and a hot seawater circulation flying lead or spray wand which allows delivery of heated fluid directly to a subsea asset using heated seawater delivered through a common hydraulic hot stab or directly to via a pressurized spraying wand.

20 Claims, 1 Drawing Sheet

(56) References Cited

U.S. PATENT DOCUMENTS 5,558,108 A * 9/1996 Croswell, Sr. ..... B08B 9/0321 134/22.12
5,597,335 A * 1/1997 Woodland ..... B63B 7/082 114/345
5,838,880 A * 11/1998 Brooks, Jr. ..... E02D 3/11 126/343.5 A
6,058,718 A * 5/2000 Forsberg ..... C02F 9/005 62/125
6,761,135 B1 * 7/2004 Becktold ..... B08B 3/026 122/396
6,820,637 B1 * 11/2004 Vertanen ..... F01P 3/20 137/340
7,811,513 B2 * 10/2010 Johnson ..... B63B 59/08 405/211
8,037,836 B2 * 10/2011 Carmichael ..... B63B 59/06 114/222
8,739,354 B2 * 6/2014 Buckner ..... E02F 3/384 134/168 C
9,398,766 B2 * 7/2016 de Ong ..... B05B 9/002
2005/0204992 A1 * 9/2005 Shelton ..... F16M 11/12 114/312
2008/0011216 A1 * 1/2008 Van-Zwol ..... B63B 59/06 114/343
2008/0040945 A1 * 2/2008 Buckner ..... E02F 3/8816 34/406
2009/0084330 A1 * 4/2009 Kloster ..... F24H 1/202 122/19.2
2010/0116128 A1 * 5/2010 Abrand ..... B01D 19/0036 95/24
2010/0326481 A1 * 12/2010 Buckner ..... E02F 3/384 134/166 C
2014/0076226 A1 * 3/2014 Smith ..... B63B 59/10 114/222
2016/0001857 A1 * 1/2016 Ledda ..... B63B 59/08 114/222
2016/0121009 A1 * 5/2016 Farr ..... H04B 13/02 250/492.1
2016/0263343 A1 * 9/2016 Hill ..... A61M 21/0094

* cited by examiner

SUBSEA ROV-MOUNTED HOT WATER INJECTION SKID

RELATION TO PRIOR APPLICATIONS

This application claims the benefit of, and priority through, U.S. Provisional Application 62/129,728, titled "Subsea ROV-Mounted Hot Water Injection Skid," filed Mar. 6, 2015.

BACKGROUND

Subsea assets may become occluded or frozen while deployed subsea. It is therefore desirable to have a subsea tool that delivers heat directly to such subsea assets. This is currently not always achievable using via heated seawater delivered to or near such a subsea asset through a common hydraulic hot stab or spraying wand.

FIGURES

Various figures are included herein which illustrate aspects of embodiments of the disclosed inventions.

Figure 1:
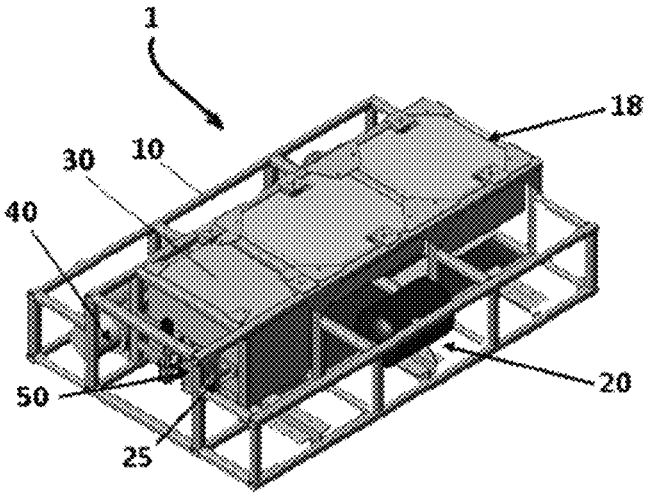
Figure 2:
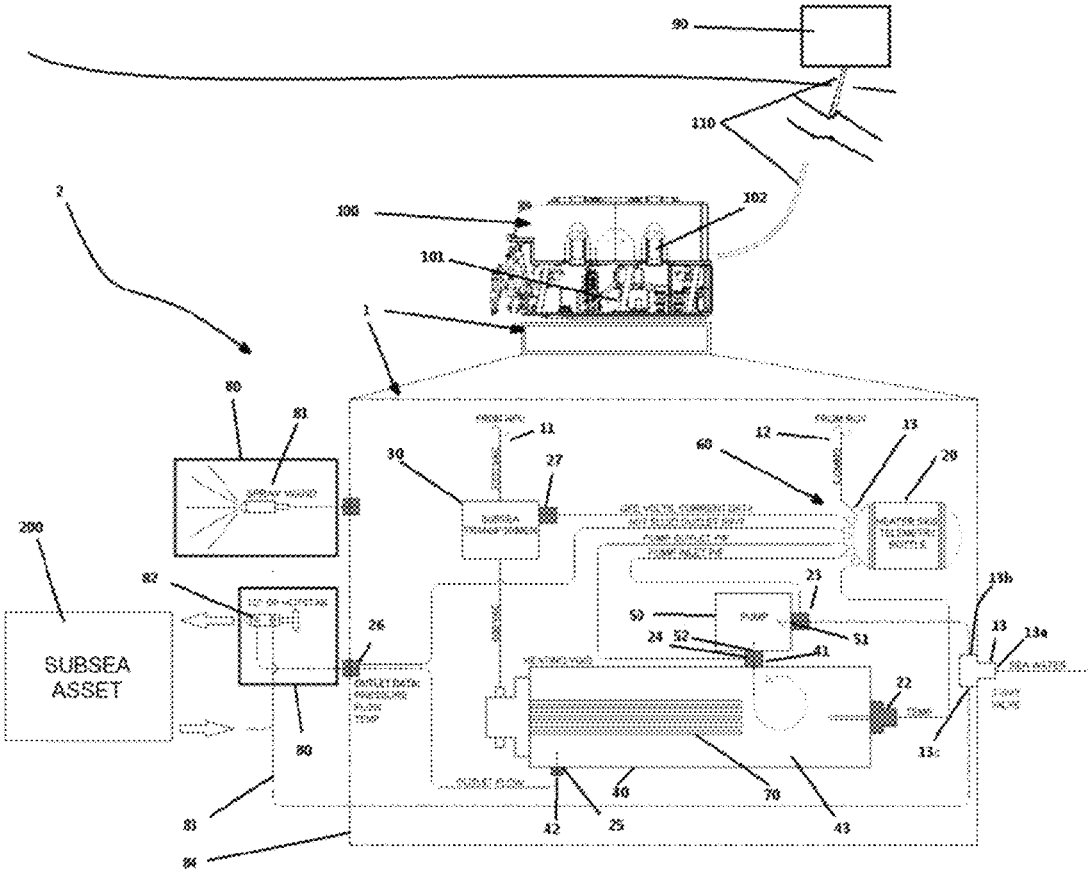

FIG. 1 is a view in partial perspective of an exemplary remotely operated vehicle mountable hot water injection skid; and FIG. 2 is a block schematic diagram of an exemplary remotely operated vehicle mountable hot water injection skid system.

DESCRIPTION OF EXEMPLARY EMBODIMENTS

Referring generally to FIG. 1, remotely operated vehicle mountable hot water injection skid 1 comprises skid frame 10, typically comprising a metal such as aluminum; one or more floats 18 disposed at least partially within skid frame 1; one or more power interfaces 11 (FIG. 2); one or more subsea power transformers 30 disposed at least partially within skid frame 1 and operatively in communication with power interface 11; one or more electrical power interfaces 60 (FIG. 2) disposed at least partially within skid frame 1, a predetermined set of electrical power interfaces 60 operatively in communication with subsea power transformer 30; one or more data communication interfaces 12 (FIG. 2) disposed at least partially within skid frame 1; one or more heater skid telemetry systems 20 disposed at least partially within skid frame 1; a predetermined set of integration equipment 25 disposed at least partially within skid frame 1, the predetermined set of integration equipment 25 operatively in communication with at least one subsea power transformer 30 and at least one heater skid telemetry system 20; water collection and heating container 40 disposed at least partially within skid frame 1; pumping and circulation system 50 disposed at least partially within skid frame 1; and hot seawater circulation flying lead system 80 (FIG. 2) in fluid communication with the water collection and heating container 40. It will be appreciated that in certain embodiments the one or more components described above may be configured for redundancy.

Referring additionally to FIG. 2, heater skid telemetry system 20 is operatively in communication with at least one subsea power transformer 30, such as via one or more electrical power interfaces 60, and at least one data communication interface 12. Heater skid telemetry system 20 may comprise a subsea, skid-mounted telemetry 1 atm canister that houses data required electronics, e.g. one or more acquisition printed circuit boards (PCBs), power conversion devices, and/or power and ground fault monitoring devices Data communication port 13, operatively in communication with data communication interface 12, is further operatively in communication with the predetermined set of integration equipment 25 and may be further operatively in communication with topside control and monitoring system 90 such as via data communication port 12 and umbilical 110 to achieve typical data rates, e.g. RS232 at up to around 115200 baud.

The predetermined set of integration equipment 25 typically comprises subsea equipment, by way of example and not limitation such as hydraulic and electrical WROV-to-Skid integration equipment. Integration equipment 25 may be used such as with one or more hydraulic hoses to integrate an ROV hydraulic supply with heater skid hydraulic inputs of pump 50; use of an electrical low voltage power and communication cable to integrate ROV low voltage power communication supply with heater skid electrical power and communications inputs; and/or use of an electrical high voltage power cable such as power interface 11 to integrate ROV high voltage power with heater skid high voltage power inputs to subsea transformer 30.

In certain embodiments, power transformer 30 comprises a high power subsea transformer, by way of example and not limitation comprising one capable of producing around 3000 VAC.

Water collection and heating container 40 typically comprises interior water chamber 43; water inlet 41 in fluid communication with interior water chamber 43; water outlet 42 in fluid communication with interior water chamber 43; and heating element 70 in fluid communication with interior water chamber 43. Heating element 70 preferably comprises a high power immersion-style heating element.

Pumping and circulation system 50 is typically in fluid communication with water collection and heating container 40 and operatively in communication with the high power subsea power transformer 30, such as via one or more electrical power interfaces 60, and the heater skid telemetry system 20. Pumping and circulation system 50 comprises a pump, typically a circulation pump and more preferably a hydraulically-powered pump capable of 3000 PSI max, 1-2 gal/min flow output.

Still referring to FIG. 2, subsea heating fluid system 2 comprises remotely operated vehicle mountable hot water injection skid 1, as described above. Further, one or more sensors, generally referred to herein as "sensors 22," may be present, disposed at least partially within skid frame 1, and operatively in communication with water collection and heating container 40 and heater skid telemetry system 20. If present, a set of sensors 22 are operatively in communication with heater skid telemetry system 20 and typically comprise pump inlet fluid sensor 23, which may comprise a pressure-flow sensor, operatively in communication with pump inlet 51; pump outlet fluid sensor 24, which may comprise a pressure-flow sensor, operatively in communication with the pump outlet 52; outlet flow sensor 25 operatively in communication with heating system fluid outlet 42; outlet data sensor 26, which may comprise a pressure-flow-temperature sensor, operatively in communication with heating system fluid outlet 42; power sensor 27, which may comprise a voltage and/or current sensor, operatively in communication with power transformer 30; and the like, or a combination thereof.

In subsea heating fluid system 2, pumping and circulation system 50 is typically in fluid communication with fluid inlet 41 and further comprises pump inlet 51 and pump outlet 52; first valve 13 in fluid communication with pumping and circulation system 50; and one or more fluid delivery systems 80 in fluid communication with first valve 13, e.g. via conduits 83 and/or 84. Fluid delivery conduit 80 may comprise a hot seawater circulation flying lead 82, a spray wand 81, or the like, or a combination thereof. First valve 13 typically comprises a three way valve, where the three way valve typically comprises first inlet 13*a* in fluid communication with an outside environment such as seawater; first outlet 13*b* in fluid communication with pumping and circulation system 50 and with first inlet 13*a*; and second outlet 13*c* in fluid communication with fluid delivery conduit system 80 and first inlet 13*a*.

In most configurations, one or more topside control and monitoring systems 90 are operatively in communication with predetermined set of integration equipment 25 via data communication port 12 and umbilical 110.

In the operation of exemplary embodiments, referring mainly to FIG. 2, heated fluid may be applied to subsea asset 200 via heated seawater equipment through a common interface style and not just on the exterior of subsea asset 200 by integrating hot water injection skid 1, as described above, with host Remotely Operated Vehicle (ROV) 100 such as by deploying hot water injection skid 1 under the belly of host ROV 100, e.g. by directly connecting hot water injection skid 1 to the belly of host ROV 100. Hot water injection skid 1 is also typically directly integrated into the electrical and hydraulic system of host ROV 100.

Once integrated, hot water injection skid 1 utilizes available electrical and hydraulic power from host ROV 100 to complete the work required by hot water injection skid 1. In typical embodiments, this work may comprise using hot water injection skid 1 to pump ambient seawater—such as via pumping and circulation system 50—into interior water chamber 43 of water collection and heating container 40. As the seawater is heated inside water collection and heating container 40, real-time environmental data may be collected, such as by using one or more sensors 22, and the data transmitted to topside system 90 where, if desired, these data or processed versions of these data may be displayed to a user via control software present at topside system 90. If present, electronics may communicate with an available communications channel from host ROV 100 dedicated to hot water injection skid 1.

Based on the real-time environmental data, host ROV 100 may be instructed or otherwise commanded to either stab output flow hot stab 82 into pre-existing subsea equipment 200 or use spray wand 81 to spray pressurized heated seawater onto asset 200, where asset may be a frozen asset. In typical configurations, this allows delivery of heated fluid directly to subsea asset 200 using heated seawater delivered through a common hydraulic hot stab 82 or directly onto frozen asset 200 via pressurized spraying wand 81.

At any appropriate time, three way input valve 13 may be closed to allow colder seawater suction to be removed from water collection and heating container 40 and/or to allow only hot water from water collection and heating container 40 to flow out through or onto asset 200.

Voltage, e.g. high voltage, may be shared via a high voltage connection, such as via umbilical 110, that powers on-board hydraulic power unit (HPU) 101 of host ROV 100 and/or by taking the power from second ROV HPU 102 of host ROV 100 if needed and applicable by electrical integration through power interface 11.

In certain embodiments hydraulic integration may require using hydraulic pressure and flow control to hot water injection skid 1 via hose connections between host ROV 100 and hot water injection skid 1.

The foregoing disclosure and description of the inventions are illustrative and explanatory. Various changes in the size, shape, and materials, as well as in the details of the illustrative construction and/or an illustrative method may be made without departing from the spirit of the invention.

The invention claimed is:

1. A remotely operated vehicle mountable hot water injection skid (1), comprising:

a. a skid frame (10);

b. a float (18) disposed at least partially within the skid frame;

c. a subsea power transformer (30) disposed at least partially within the skid frame;

d. a power interface (11) disposed at least partially within the skid frame (1) and operatively in communication with the subsea power transformer (30);

e. an electrical power interface (60) disposed at least partially within the skid frame, the electrical power interface operatively in communication with the subsea power transformer;

f. a data communication interface (12) disposed at least partially within the skid frame;

g. a heater skid telemetry system (20) disposed at least partially within the skid frame, the heater skid telemetry system operatively in communication with the subsea power transformer and the data communication interface;

h. a predetermined set of integration equipment (25) disposed at least partially within the skid frame, the predetermined set of integration equipment operatively in communication with the subsea power transformer and the heater skid telemetry system (20);

i. a water collection and heating container (40) disposed at least partially within the skid frame, the water collection and heating container (40) comprising:

i. an interior water chamber (43);

ii. a water inlet (41) in fluid communication with the interior water chamber;

iii. a water outlet (42) in fluid communication with the interior water chamber; and iv. a heating element (70) in fluid communication with the interior water chamber;

j. a pumping and circulation system (50) disposed at least partially within the skid frame, the hydraulically-powered pumping and circulation system (50) in fluid communication with the water collection and heating container (40), the pumping and circulation system (50) operatively in communication with the subsea power transformer and the heater skid telemetry system (20).

2. The remotely operated vehicle mountable hot water injection skid of claim 1, wherein the data communication port is operatively connected to the predetermined set of integration equipment.

3. The remotely operated vehicle mountable hot water injection skid of claim 1, wherein the skid frame comprises aluminum.

4. The remotely operated vehicle mountable hot water injection skid of claim 1, wherein the predetermined set of integration equipment (25) comprises hydraulic and electrical WROV-to-Skid integration equipment.

5. The remotely operated vehicle mountable hot water injection skid of claim 1, wherein the subsea power transformer (30) comprises a high power subsea power transformer.

6. The remotely operated vehicle mountable hot water injection skid of claim 1, wherein the heating element (70) comprises a high power immersion-style heating element.

7. The remotely operated vehicle mountable hot water injection skid of claim 1, wherein the pumping and circulation system (50) comprises a hydraulically-powered pumping and circulation system (50).

8. A subsea heating fluid system (2), comprising:

a. a remotely operated vehicle mountable hot water injection skid (1), comprising:
   i. a skid frame (10);
   ii. a power interface (11) disposed at least partially within the skid frame;
   iii. a power transformer (30) disposed at least partially within the skid frame, the power transformer operatively in communication with the power interface;
   iv. a data communication interface (12) disposed at least partially within the skid frame;
   v. a heater skid telemetry system (20) disposed at least partially within the skid frame, the heater skid telemetry system operatively in communication with the power transformer and the data communication interface;
   vi. a heating system (40), comprising:
      1. a water collection and heating void container (40), comprising an interior chamber (43);
      2. a heating element (70) disposed at least partially within the water collection and heating void container;
      3. a fluid inlet (41) in fluid communication with the water collection and heating void container; and
      4. a fluid outlet (42) in fluid communication with the water collection and heating void container;
   vii. a sensor (22) disposed at least partially within the skid frame and operatively in communication with the heating system and the heater skid telemetry system;
   viii. a pumping and circulation system (50) in fluid communication with the heating system fluid inlet (41), the pumping and circulation system comprising a pump inlet (51) and a pump outlet (52);
   ix. a first valve (13) in fluid communication with the pumping and circulation system (50) and the fluid delivery wand (80); and
   x. a fluid delivery conduit (80) in fluid communication with the first valve; and b. a topside control and monitoring system (90) operatively in communication with the predetermined set of integration equipment via the data communication port (12).

9. The heating system of claim 8, wherein the heating element (70) comprises a high power immersion-style heating element.

10. The heating system of claim 8, wherein the power transformer (30) comprises a high power subsea transformer.

11. The heating system of claim 10, wherein the high power subsea transformer comprises a 3000 VAC high power subsea transformer.

12. The heating system of claim 8, wherein the pumping and circulation system (50) further comprises a hydraulically-powered pumping and circulation system (50).

13. The heating system of claim 8, further comprising a predetermined set of integration equipment (25) disposed at least partially within the skid frame.

14. The heating system of claim 8, wherein the fluid delivery conduit (80) comprises at least one of a hot seawater circulation flying lead (82) or a spray wand (81).

15. The heating system of claim 8, wherein the first valve (13) comprises a three way valve, the three way valve comprising:

a. a first inlet (13*a*) in fluid communication with an outside environment;
b. a first outlet (13*b*) in fluid communication with the heating system fluid outlet (42) and with the first inlet; and
c. a second outlet (13*c*) in fluid communication with the fluid delivery system (80) and the first inlet.

16. The heating system of claim 8, further comprising a set of sensors (22) operatively in communication with the heater skid telemetry system (20), the set of sensors comprising:

a. a pump inlet fluid sensor (23) operatively in communication with the pump inlet (51);
b. a pump outlet fluid sensor (24) operatively in communication with the pump outlet (52);
c. an outlet flow sensor (25) operatively in communication with the heating system fluid outlet (42);
d. an outlet data sensor (26) operatively in communication with the heating system fluid outlet (42); and
e. a power sensor (27) operatively in communication with the power transformer (30).

17. The heating system of claim 16, wherein:

a. the pump inlet fluid sensor (23) comprises a pressure-flow sensor;
b. a pump outlet fluid sensor (24) comprises a pressure-flow sensor;
c. the outlet data sensor (26) comprises a pressure-flow-temperature sensor; and
d. the power sensor (27) comprises a voltage and/or current sensor.

18. A method of applying a heated fluid to a subsea asset via heated seawater equipment through a common interface style and not just on the exterior of the asset, comprising:

a. integrating a hot water injection skid (1) directly with a host Remotely Operated Vehicle (ROV) by deploying the hot water injection skid (1) under a belly of the host ROV (100), the hot water injection skid (1) comprising
   i. a skid frame (10);
   ii. a float (18) disposed at least partially within the skid frame;
   iii. a subsea power transformer (30) disposed at least partially within the skid frame;
   iv. a power interface (11) disposed at least partially within the skid frame (1) and operatively in communication with the subsea power transformer (30);
   v. an electrical power interface (60) disposed at least partially within the skid frame, the electrical power interface operatively in communication with the subsea power transformer;
   vi. a data communication interface (12) disposed at least partially within the skid frame;
   vii. a heater skid telemetry system (20) disposed at least partially within the skid frame, the heater skid telemetry system operatively in communication with the subsea power transformer and the data communication interface;
   viii. a predetermined set of integration equipment (25) disposed at least partially within the skid frame, the predetermined set of integration equipment operatively in communication with the subsea power transformer and the heater skid telemetry system (20);

ix. a water collection and heating container (40) disposed at least partially within the skid frame, the water collection and heating container (40) comprising:

1. an interior water chamber (43);
2. a water inlet (41) in fluid communication with the interior water chamber;
3. a water outlet (42) in fluid communication with the interior water chamber; and
4. a heating element (70) in fluid communication with the interior water chamber;

x. a pumping and circulation system (50) disposed at least partially within the skid frame, the hydraulically-powered pumping and circulation system (50) in fluid communication with the water collection and heating container (40), the pumping and circulation system (50) operatively in communication with the subsea power transformer and the heater skid telemetry system (20); and b. directly integrating the hot water injection skid (1) into an electrical and hydraulic system of the host ROV (100);

c. operatively placing a fluid delivery conduit (80) in fluid communication with the water collection and heating container (40) water outlet;

d. operatively placing a first valve (13) in fluid communication with the pumping and circulation system (50) and the fluid delivery conduit;

e. once integrated, allowing the hot water injection skid (1) to utilize available electrical and hydraulic power from the host ROV (100) to complete a predetermined set of tasks, the utilization comprising:

i. using the hot water injection skid to pump ambient seawater—via a circulation pump—into the interior water chamber of the heating chamber;

ii. heating the seawater is heated inside the heating chamber;

iii. as the seawater is heated inside the heating chamber, collecting real-time environmental data;

iv. transmitting the real-time environmental data to a topside system for display to a user via topside control software;

v.

19. The method of applying a heated fluid to a subsea asset via heated seawater equipment through a common interface style and not just on the exterior of the asset of claim 18, further comprising instructing the host ROV, based on the real-time environmental data, to either stab an output flow hot stab of the fluid delivery conduit into a pre-existing subsea equipment hot stab receptor or spray pressurized heated seawater at a frozen asset from a fluid delivery conduit spray wand.

20. The method of applying a heated fluid to a subsea asset via heated seawater equipment through a common interface style and not just on the exterior of the asset of claim 18, further comprising closing the first valve to allow colder seawater suction to be removed from the circuit and to allow only hot water from the heating system to flow out through or onto the subsea asset.

* * * * *